US010327309B1

(12) United States Patent
Verdi et al.

(10) Patent No.: US 10,327,309 B1
(45) Date of Patent: Jun. 18, 2019

(54) RETROFIT LIGHTING SYSTEM, METHOD, APPARATUS AND KIT

(71) Applicants: Danyel Verdi, Los Angeles, CA (US); Benjamin Verdi, Los Angeles, CA (US)

(72) Inventors: Danyel Verdi, Los Angeles, CA (US); Benjamin Verdi, Los Angeles, CA (US)

( * ) Notice: Subject to any disclaimer, the term of this patent is extended or adjusted under 35 U.S.C. 154(b) by 0 days.

(21) Appl. No.: 15/974,514

(22) Filed: May 8, 2018

(51) Int. Cl.

| | |
|---|---|
| ***F21K 9/23*** | (2016.01) |
| ***H05B 37/02*** | (2006.01) |
| ***F21V 21/04*** | (2006.01) |
| ***F21V 23/00*** | (2015.01) |
| *F21S 8/06* | (2006.01) |
| *F21S 6/00* | (2006.01) |

(52) U.S. Cl.
CPC ..... *H05B 37/0245* (2013.01); *F21K 9/23* (2016.08); *F21V 21/04* (2013.01); *F21V 23/006* (2013.01); *F21S 6/007* (2013.01); *F21S 8/06* (2013.01)

(58) Field of Classification Search
CPC ..... H05B 37/0245; F21K 9/23; F21K 9/238; F21K 9/233; F21K 9/27; F21K 9/278; F21V 21/04; F21V 23/006; F21V 21/02; F21S 6/007; F21S 8/06; F21Y 2113/00; F21Y 2113/13; F21Y 2115/10
See application file for complete search history.

(56) References Cited

U.S. PATENT DOCUMENTS

2017/0314750 A1* 11/2017 Feldman ..... F21S 8/026

* cited by examiner

*Primary Examiner* — Bao Q Truong

(57) ABSTRACT

A retrofit lighting fixture comprises a lighting fixture component and a retrofit component. The lighting fixture component comprises a primary light component, a primary trim and a primary power component. The retrofit component comprises a secondary light component, a lighting frame and a secondary power component.

15 Claims, 7 Drawing Sheets

RETROFIT LIGHTING SYSTEM, METHOD, APPARATUS AND KIT

TECHNICAL FIELD

The exemplary embodiments generally relate to lighting fixtures and particularly to lighting systems, methods, apparatuses and kits involving a retrofit component.

BACKGROUND

A wide variety of specialized lighting fixtures are currently available on the market for residential or domestic use. However, in some instances it may be desirable to supplement such fixtures with a retrofit component. For example, retrofitting a lighting fixture to retain its desirable attributes (aesthetic, functional, etc.) while providing additional functionalities, such as independent light components, can be advantageous.

SUMMARY

In an exemplary embodiment a retrofit lighting system comprises, a recessed lighting fixture comprising, a primary light component, a primary trim comprising a top side and an underside, and a primary power component. The recessed lighting fixture is configured to permit light from the primary light component to pass through the primary trim. The system further comprises a retrofit component comprising, a secondary light component, a lighting frame comprising a top side and an underside, and a secondary power component. The recessed lighting fixture and retrofit component are configured to secure to each other such that the secondary light component is located between the primary trim and the lighting frame. Additionally, the system is configured to permit light from the primary light component and secondary light component to pass through the lighting frame. Further, the system is configured to supply power independently to the primary and secondary light components.

Additionally, in an exemplary embodiment, a retrofit lighting kit comprises a secondary light component, a lighting frame and a secondary lighting frame. The kit can be configured to position the secondary light component between a primary trim of a lighting fixture and the lighting frame.

In another exemplary embodiment, a method of retrofitting a lighting fixture comprises (a) providing a lighting fixture comprising a primary trim, a primary light component and a primary power source, (b) providing a secondary light component, (c) providing a lighting frame, and (d) positioning the secondary light component between the primary trim and the lighting frame and securing the lighting frame to the primary trim.

DETAILED DESCRIPTION OF THE EMBODIMENTS

Figure 1:
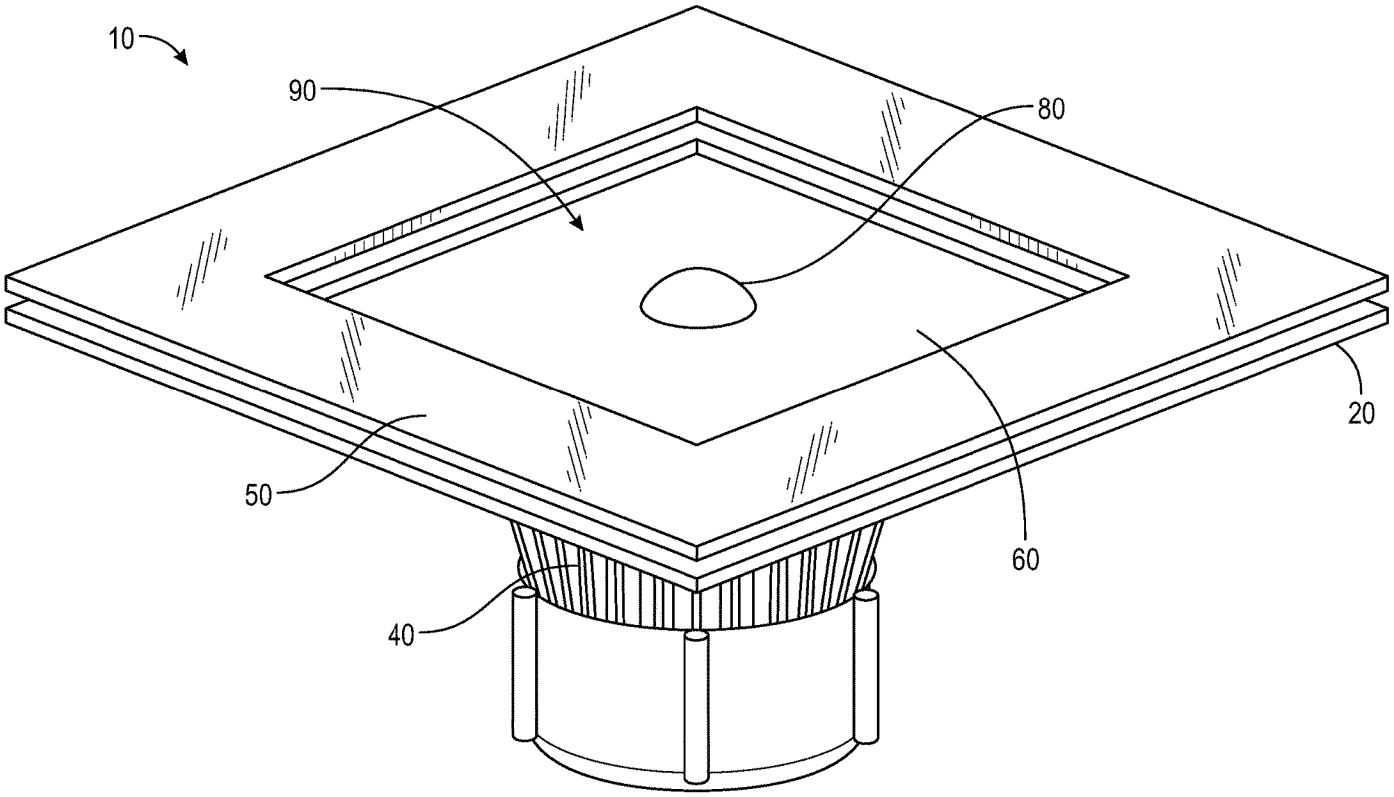
FIG. 1 is a perspective view of a retrofit lighting system in accordance with an exemplary embodiment.

The present disclosure provides systems, apparatuses, methods and kits directed to retrofitting a variety of lighting fixtures. Although the disclosure describes exemplary embodiments within the context of recessed lighting fixtures, essentially any type of lighting fixture compatible with the present solutions, is contemplated herein. For instance, a number of ambient lighting, task lighting or accent lighting fixtures, among others may be candidates for retrofitting as described herein. Further examples include, wall mounted fixtures, ceiling mounted fixtures, track lighting, directional lighting, pendant lighting, desk lighting, table lamps, spotlights, post lanterns, chandeliers, floor lamps, among others.

Additionally, references to retrofit systems, methods, apparatuses and kits herein generally denote an accessory for a lighting fixture. Accordingly, in exemplary embodiments, the retrofit component maybe a component added to a fixture after manufacture. In some instances, the retrofit component may be added during the manufacturing stage. For example, the retrofit component may be part of the fixture sold by the manufacturer that is secured to, or detachable from, the fixture. Additionally, the retrofit component may be a kit that is sold separately from or along with the fixture, such that the component may be installed by the purchaser or consumer.

In an exemplary embodiment, a retrofit lighting system comprises a recessed lighting fixture. The lighting fixture comprises a primary light component, a primary trim and a primary power component as further described. In a non-limiting example, the recessed lighting fixture is a standard ceiling mounted recessed light. The primary light component may comprise a single or a plurality of lights, essentially in any arrangement. One or more of the lights may be dimmable.

The recessed lighting fixture can be configured to permit light from the primary light component to pass through the primary trim. In particular, the primary trim can be opaque, transparent or translucent. Exemplary types of trims include, but are not limited to, shower trims, wall-wash trims, pin hole trims, gimbal trims, eyeball trims, open trims, reflector trims and baffle trims. In an exemplary embodiment, the primary trim comprises a central opening. With this configuration, light from the primary light component may pass through the central opening with little or no obstruction. In some instances, the primary trim may be a diffuser or comprise a translucent portion whereby at least a portion of the light passes through the primary trim material.

The primary trim may comprise a top portion and an interior portion. In an exemplary embodiment, the primary trim comprises a substantially flat top portion arranged to receive a secondary light component, as further described herein. In some instances, the top side of the primary trim is the only visible portion of the trim of the recessed lighting fixture, when installed.

The system may further comprise a secondary trim configured to attach to the primary trim of the lighting fixture. In such instances, the secondary light component may be disposed on the secondary trim such that once installed, the secondary light component is positioned between the secondary trim and the lighting frame. The secondary trim may be detachable or permanently secured to the primary trim and take on any shape which permits light from the primary light component through. For example, the secondary trim may resemble the shape of the top portion of the primary trim.

The recessed lighting fixture also comprises a primary power component. The primary power component can comprise wiring or any other electrical unit typically utilized for supplying power from a power source, to the primary light component. The power source can be any source of AC, DC or a combination thereof. For example, the primary power source can comprise an AC outlet or a battery.

Various portions of the recessed lighting fixture may be located in a housing. For instance, at least some portions of the trim, primary light component, primary power component, or a combination thereof, may be located in the housing. Further, the housing may be secured to the primary trim either detachably or permanently. For instance, the primary trim and housing may have complementary interlocking members to form an attachment, or secured together with additional elements such as clips, screws, adhesives, or any other attachment mechanisms.

Exemplary embodiments further comprise a retrofit component, comprising a secondary light component, a lighting frame and a secondary power component. The retrofit component is configured to provide an additional source of light, while permitting light from the primary light component and secondary light component to pass through the lighting frame. As such, the lighting frame may comprise a variety of shapes including those resembling or identical to the primary trim. For instance, the lighting frame maybe constructed from one or more pieces. Moreover, the shape, configuration, choice of material or a combination of both may be designed to allow light from the primary light component and secondary light component to pass through.

With respect to shape, the lighting frame may resemble a ring, (e.g. circular, square, etc.) or be in the shape of a panel comprising a central opening. In such instances, the light from primary lighting source passes through with little or no obstruction. The lighting frame may also comprise a plurality of openings, for example at a central location, to allow passage of light with some obstruction. In some instances, the lighting frame may comprise a removable or adjustable piece, for manually or remotely (described further below) adjusting lighting. Examples could include sliding panels, removable inserts, adjustable apertures, and other similar mechanisms. Although the accompanying figures illustrate substantially flat lighting frames, it is to be understood that curved or irregularly shaped frames that exhibit the described features are also contemplated. Moreover, the lighting frame may have two or more layers. The layers may be configured to reposition, move or slide with respect to each other. The lighting frame may comprise attachment members that are complementary to attachment members on the primary trim, housing, or any other portion of the lighting fixture to form an attachment. In particular, the attachment mechanism may comprise clips, screws, adhesives, or any other attachment mechanisms.

The material of the lighting frame can be selected based on the intended application, desired aesthetics or lighting effect, among other things. Thus, lighting frame designs with or without an opening, may be comprise transparent, translucent or opaque portions. In an exemplary embodiment, at least a portion of the lighting frame may be transparent or translucent to allow light from the primary light source to pass through said portion. In a specific example, at least a portion of the lighting frame acts as a diffuser. As such, it can be a light scattering material, such as a frosted panel, such that when placed in the path of a source of light reduces the sharpness of shadows and softens light. In one example, when the secondary light component is turned on, its light through the lighting frame produces a substantially uniformly lit ring (square, circular, etc.) of light.

The material of the lighting frame need not be uniform throughout the frame. For example, portions maybe be opaque, transparent, translucent or a combination thereof. For instance, the central portion may be transparent while the outer circumference is translucent. As such, any combination of materials having translucency, transparency or opacity suitable for the intended application of the retrofit system, apparatus or kits described, is contemplated. Non-limiting material examples include polymeric, ceramic, metallic or any combination thereof. Non-limiting examples of polymeric materials includes acrylics and polycarbonates. Additionally, the lighting frame material may be colored, doped, tinted or painted to provide special coloring or lighting effects.

The secondary light component can comprise one or more secondary lights. In an exemplary embodiment, the secondary light component comprises a plurality LED lights disposed on a primary trim (or secondary trim as further describe below) such that when the recessed lighting fixture and retrofit component are secured to each other, the secondary light component is located between the primary trim (or secondary trim) and the lighting frame. In particular, the trim may comprise top surface configured to receive the plurality of lights. For instance, it may comprise grooves, notches, adhesives or any other feature to facilitate attachment.

The plurality of LEDs lights may be in any arrangement suitable for the retrofit lighting fixtures of the exemplary embodiments. For instance, the arrangements may be directed towards, among other things, power efficiency, luminous efficacy, ease of installation, aesthetics or other such considerations. In particular, all LED types, including colored LED lights, are contemplated herein. In an exemplary embodiment at least one row of LED lights is disposed about a central opening of the fixture. The lights may be disposed adjacent to the circumference of the central opening, the outer circumference of the lighting frame or a combination thereof. In a specific example, the LED lights are disposed continuously about a central opening such that they produce the effect of a ring of light through the lighting frame.

In an exemplary embodiment, the secondary light component comprises a plurality of LED lights attached to a backing. For instance, the secondary light component may comprise one or more flexible circuit boards with a plurality of LEDs. Moreover, the plurality of lights can be electrically interconnected and arranged in parallel or in series. The plurality of LED lights may be sequentially connected and continuously disposed on the trim. A non-limiting example of the secondary light component includes LED strip lights. This form of strip light may further comprise an adhesive or an attachment mechanism for securing the strip to the primary (or secondary) trim, for example, in a straight or circular line.

The secondary power component comprises electrical components for powering one or more secondary light components. In an exemplary embodiment, the secondary power component comprises an LED driver or a current regulator. The secondary power component may further comprise a USB connection for powering the secondary light components from DC power source such as a battery or another device comprising a USB port.

The primary power component and secondary component may be different or the same. For instance, the same power component may drive both the primary light source and the secondary light source, while providing the ability to independently control (e.g. brightness, on/off etc.) each light source. Of course, the same may be accomplished with different power components. Accordingly, the power component(s) may be connected to a physical switch or graphical interface permitting the independent control, such as dimming or turning off the device. Furthermore, the power component(s) may be at least partly located within the housing.

Advantageously, a user may utilize the light from the primary light component, and supplement or change the lighting by turning on the secondary light component. As a non-limiting example, the primary light component may comprise a dimmable incandescent light. When the incandescent lighting is not desired, it may be dimmed down or turned off, while turning on the Secondary light component comprising LED lighting. Thus the combination of independently operating and dimmable light components advantageously affords a wide range of lighting options.

In an exemplary embodiment, the power component is connected to a remote device for controlling power to one or more light components. Non-limiting examples include a wireless device in communication with the power component(s) over Wi-Fi, Bluetooth or any other wireless technology. The wireless device may be a mobile phone, tablet, laptop, or any other computing device with an application for remote connection to the power component(s). Thus, advantageously, the primary light component, the secondary light component or both may controlled using a mobile device application to change the lighting in one or more spaces. Of course, with a plurality of LED lights, other modes of lighting may be programmed for special effects.

As described previously, the retrofit lighting system may be manufactured as detachable components and distributed together or separately. Accordingly, in an exemplary embodiment a kit comprises a secondary light component, a lighting frame and a secondary power component. In some instances, the kit may further comprise a secondary trim. Any combination of these components may be attachable or manufactured as permanently attached to another component. For instance, the secondary light component may comprise attachment elements (interlocking members, adhesives, etc.) whereby it is secured to a primary trim, secondary trim, lighting frame or a combination thereof. Alternatively, the kit may comprise a secondary light component already attached or integrated into a secondary trim, lighting frame or both.

The design considerations of the kit components can be the same as discussed previously. For instance, the power components including any LED drivers and wireless communication devices may be included in the kit. Advantageously, a recessed lighting frame may be retrofitted with a variety of retrofit LED light components to add wireless functionality, added lighting effects, among other things.

The present disclosure allows retrofitting a wide variety lighting fixtures such as a recessed lighting fixture. Accordingly, in an exemplary embodiment a method of retrofitting a lighting fixture comprises (a) providing a lighting fixture comprising a primary trim, a primary light component (optionally) and a primary power source, (b) providing a secondary light component (c) providing a lighting frame, and (d) securing the lighting frame to the lighting fixture such that the secondary light component is positioned between the primary trim and the lighting frame. Again, power to the light components is independently controllable and each light component may be powered by the same or different power components. The secondary light components may comprise a plurality of LED lights and disposed about a central opening of the primary trim.

Further, the method may comprise a secondary trim. In such cases, the secondary trim is secured to the primary trim such that a plurality of LED lights are positioned between the secondary trim and the lighting frame. The secondary frame may be permanently or detachably secured to the lighting frame. Thus, the secondary light may be integrated with or attachable to the secondary frame, lighting frame or both. Here too, wireless communication devices may be further connected to the secondary lighting frame to permit additional modes of operation.

Figure 4:
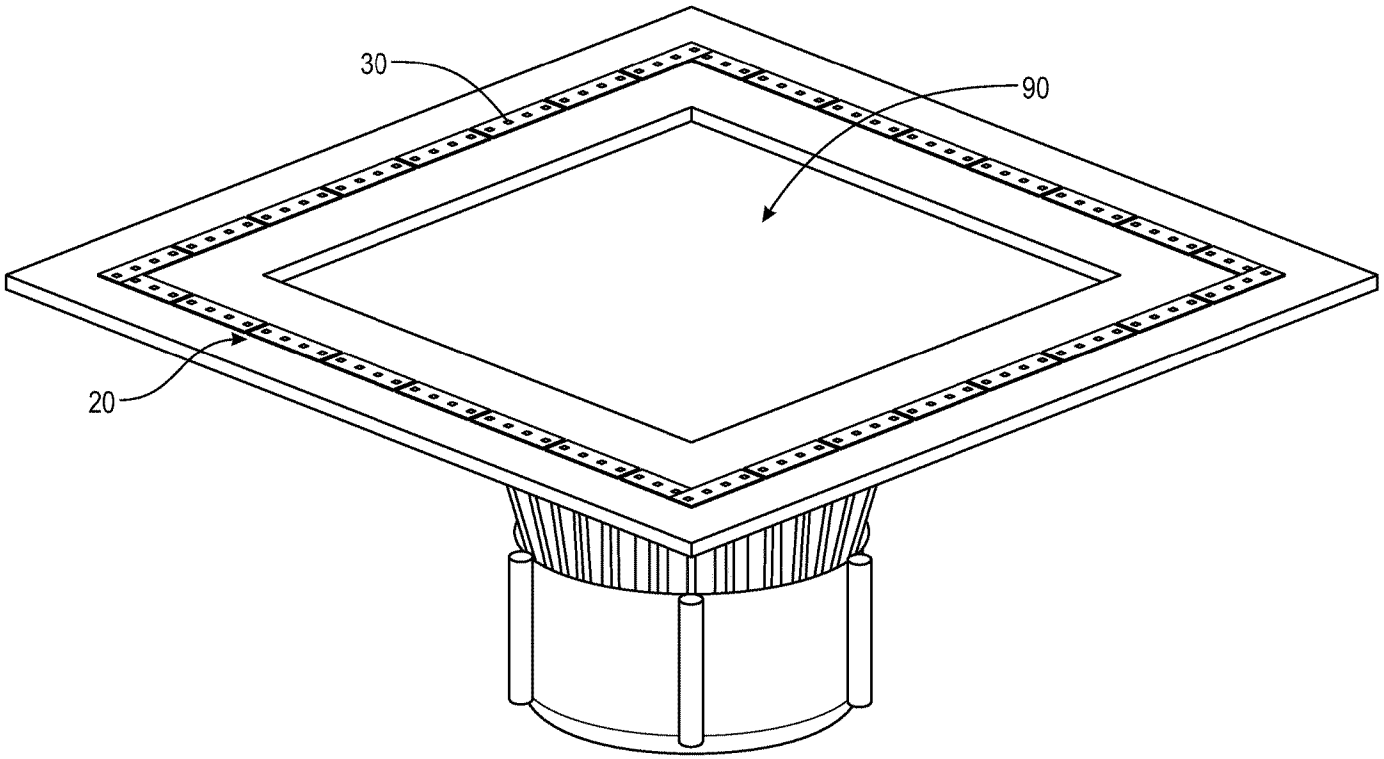
FIG. 4 is perspective view of a retrofit lighting system shown without the lighting frame in accordance with an exemplary embodiment.

Certain features of the exemplary embodiments are further illustrated in the accompanying non-limiting figures. As shown in FIG. 1, the retrofit lighting system 10 comprises a primary trim 20 connected to a housing 40. The interior portion 60 shown may be the interior of the housing 40, the trim 20 or both. The primary light component 80 is located in the interior portion 60. Both the primary trim and the lighting frame 50 comprise a central opening 90 permitting light from the primary light component 80 to pass through. Here both the primary trim 20 and the lighting frame 50 comprise a substantially similar top surface. The system further comprises secondary light components (not shown) underneath the lighting frame 50. A system similar to that of FIG. 1 is shown in FIG. 4, without the lighting frame. Here, the secondary light components 30 are disposed continuously about the central opening on the square top surface of the primary trim 20.

Figure 2:
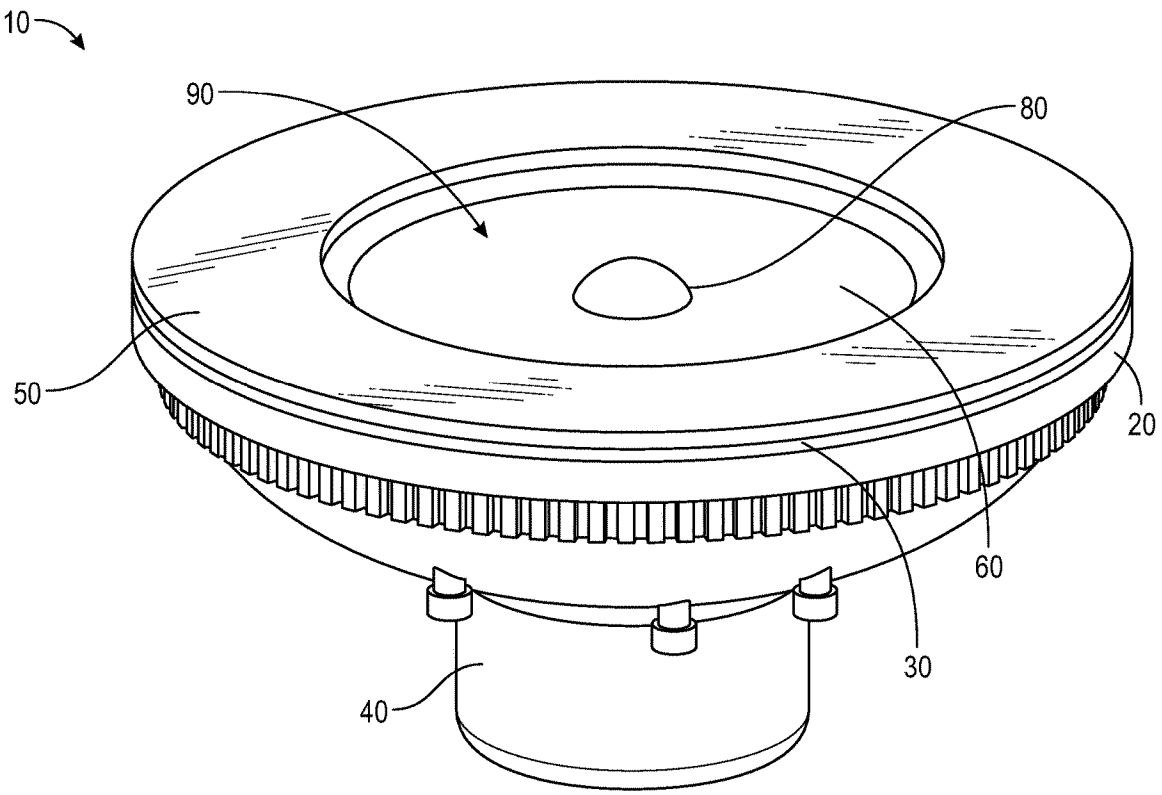
FIG. 2 is a is a perspective view of another retrofit lighting system in accordance with an exemplary embodiment.
Figure 5:
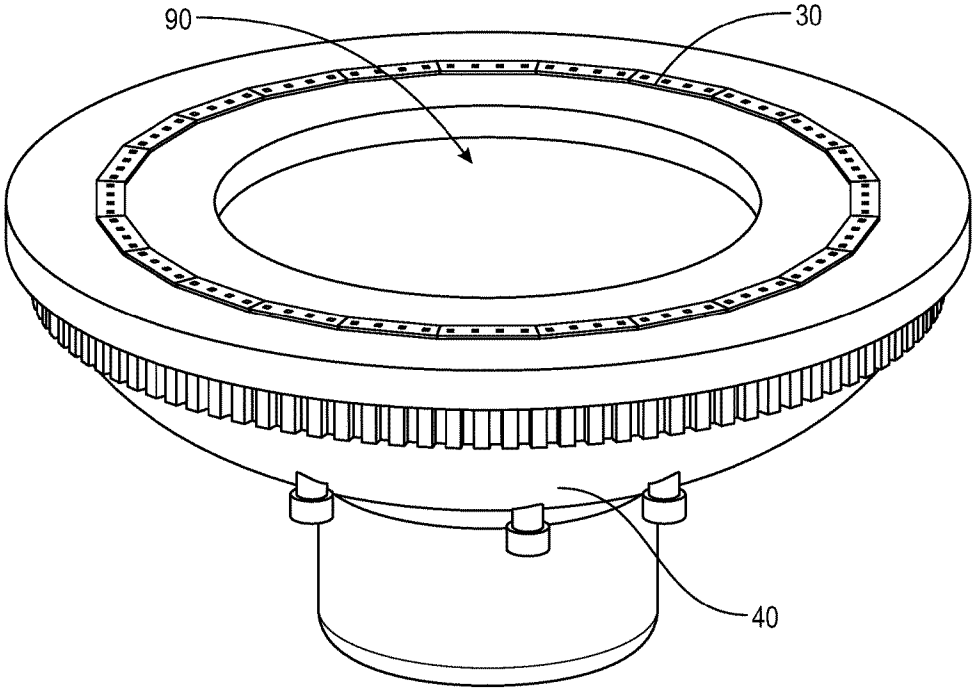
FIG. 5 is a perspective view of another retrofit lighting system shown without the lighting frame in accordance with an exemplary embodiment.

The system 10 shown in FIG. 2 also comprises a primary light source 80 positioned within the interior space 60 of the housing 40 or primary trim 20. The secondary light components 30 are disposed on the primary trim 20 and located underneath the lighting frame 50. Here, the primary trim 20 and lighting frame 50 are again similarly circular with a central opening 90 permitting passage of light from the primary light component 80. A system similar to that of FIG. 2 is shown in FIG. 5, without the lighting frame. Here, the secondary light components 30 are disposed continuously about the central opening 90 on the circular top surface of primary trim 20.

Figure 3:
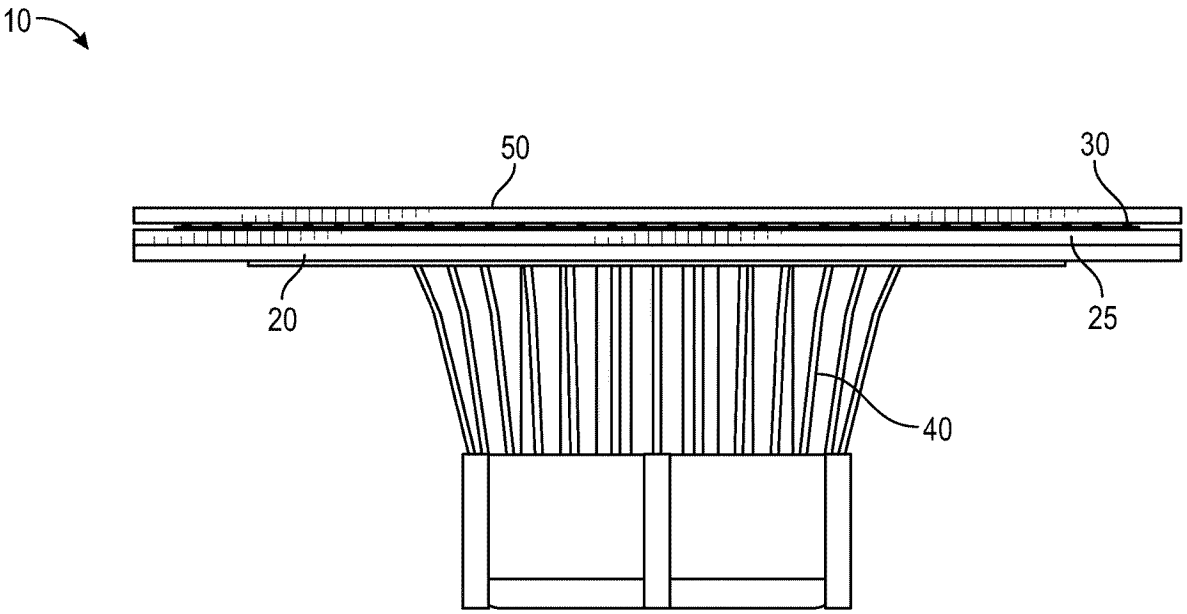
FIG. 3 is a side view of a retrofit lighting system in accordance with an exemplary embodiment.

The side view provided in FIG. 3, illustrates among other things, a system 10 with a secondary trim 25. As such, the secondary light components 30 are disposed on the secondary trim 25 and under the lighting frame 50. The secondary trim 25 is attached to the primary trim.

Figure 6:
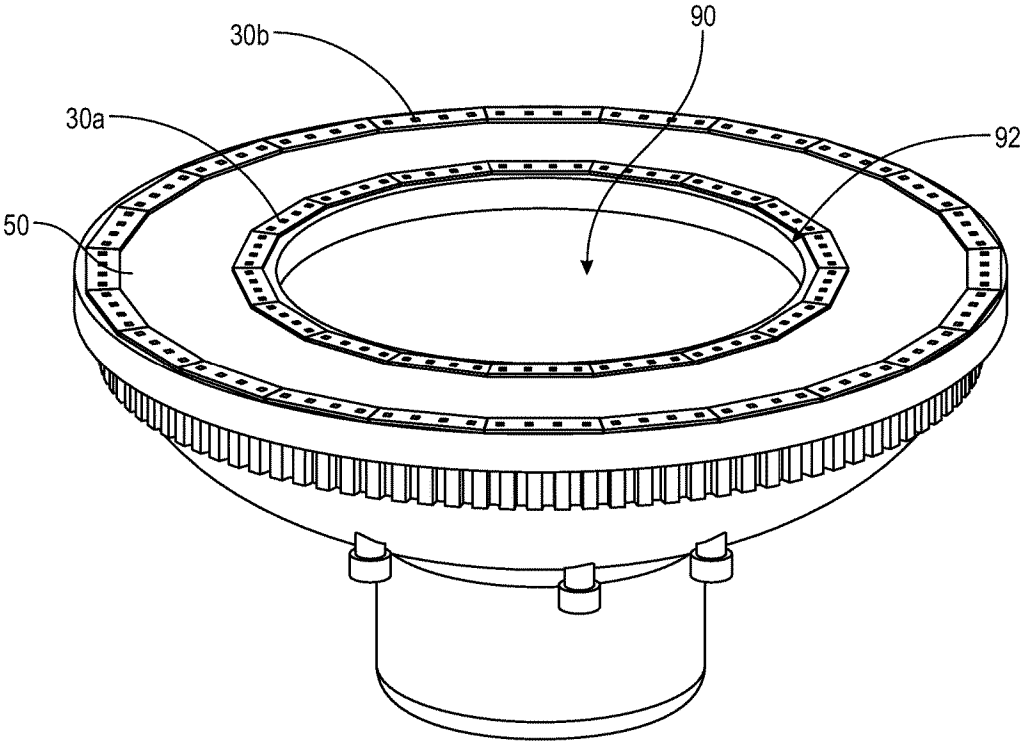
FIG. 6 is a perspective view of yet another retrofit lighting system shown without the lighting frame in accordance with an exemplary embodiment.

Yet another exemplary embodiment is illustrated in FIG. 6, without the lighting frame. Here the system comprises two continuous arrangements of LED lights (shown simplified). As shown, one row of the primary light component 30*a* is disposed on the primary trim 50 adjacent to the circumference 92 of the central opening 90. Another row 30*b* is disposed adjacent to the outer perimeter of the primary trim 50. The primary light components 30*a, b* may be connected to each other or separately connected to the secondary power component (not shown). In this example, when the secondary light source is lit, the lighting frame may produce one or two rings of light.

Figure 7:
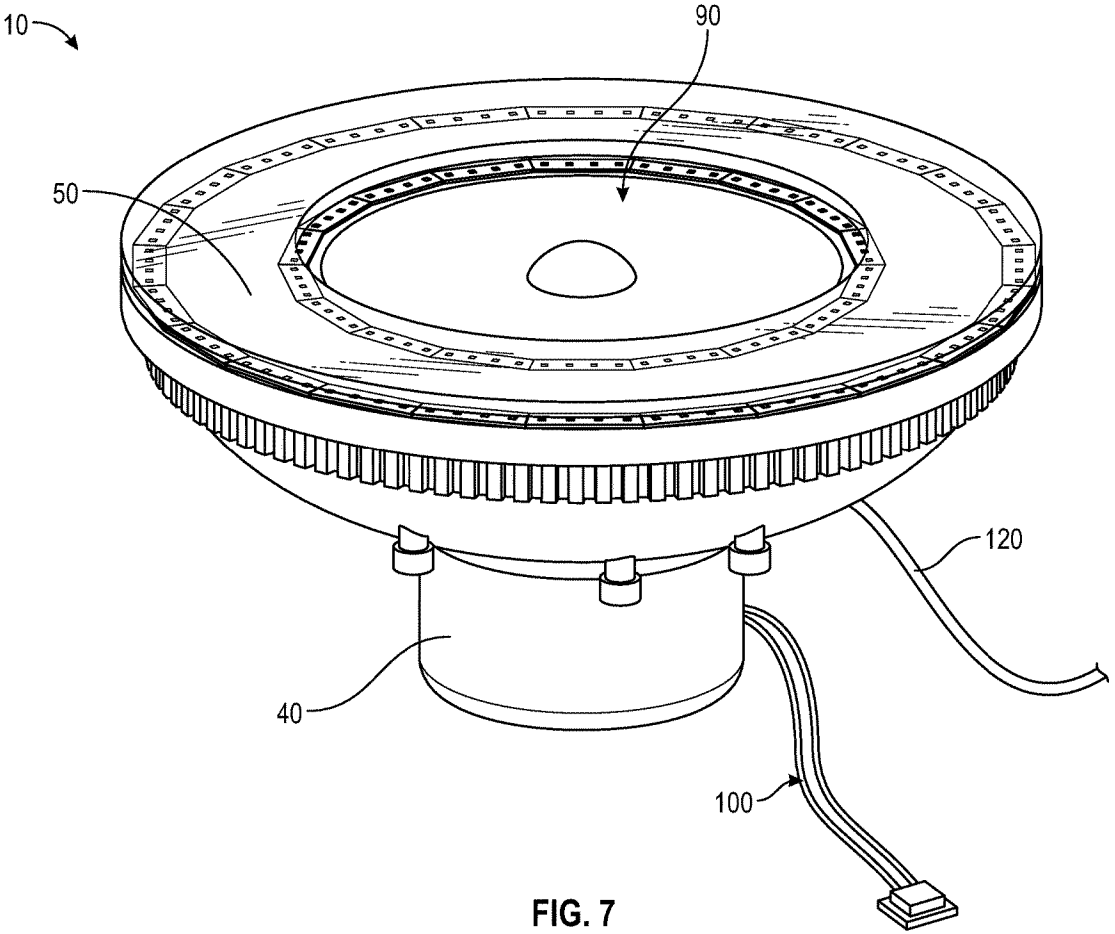
FIG. 7 is an image of a retrofit lighting system showing power components in accordance with an exemplary embodiment.

In the system 10 depicted in FIG. 7 the wiring of the primary power component 100 and that of the secondary power component 120 are shown. The primary component 100 supplies power to the primary light component located in the central opening 90, and the secondary power component 120 supplies power to the secondary light component. Of course, the wiring for the secondary power component may comprise a connectivity, such as a USB for, connecting to a portable power source or another electronic device.

Having thus described several aspects of the exemplary embodiments, it is to be appreciated various alterations, modifications, and improvements will readily occur to those skilled in the art. Such alterations, modifications, and improvements are intended to be part of this disclosure, and are intended to be within the scope of the embodiments. Accordingly, the foregoing description and drawings are by way of example only and are non-limiting.

What is claimed is:

1. A retrofit lighting system comprising:

a recessed lighting fixture comprising, a primary light component;

a primary trim comprising a top side and an underside; and a primary power component;

wherein the recessed lighting fixture is configured to permit light from the primary light component to pass through the primary trim, and a retrofit component comprising, a secondary light component;

a lighting frame comprising a top side and an underside; and a secondary power component, wherein the recessed lighting fixture and retrofit component are configured to be secured to each other such that the secondary light component is located between the primary trim and the lighting frame, wherein the system is configured to permit light from the primary light component and secondary light component to pass through the lighting frame, and wherein the system is configured to supply power independently to the primary and secondary light components.

2. The system of claim 1, wherein primary trim comprises a central opening permitting light from the primary light component through said opening.

3. The system of claim 2, wherein the secondary light component is disposed continuously about the central opening on the top side of the primary trim.

4. The system of claim 3, wherein the secondary light component comprises a plurality of sequentially connected LED lights.

5. The system of claim 4, wherein the secondary light components comprises a first plurality of serially connected LED lights disposed adjacent to the circumference of the central opening, and a second plurality of serially connected LED lights disposed adjacent to the outer circumference of the primary trim.

6. The system of claim 1, wherein the lighting frame is translucent and arranged to diffuse light from secondary light component.

7. The system of claim 1, wherein the lighting frame comprises a central opening and is configured to detachably secure to the lighting fixture.

8. The system of claim 1, wherein in the retrofit component further comprises a secondary trim configured to be secured to the primary trim, such that the secondary trim is positioned between the primary trim and the secondary light component.

9. The system of claim 1, further comprising a secondary power component configured to power the secondary light component independently from the primary light component.

10. The system of claim 9, wherein the system is configured such that the secondary light component is remotely controllable using a computing device.

11. A retrofit lighting kit comprising:

a secondary light component;

a lighting frame comprising a top side and an underside; and a secondary power component, wherein the lighting frame is configured to attach to a primary trim of a recessed lighting fixture, such that the secondary light components are positioned between the primary trim and the lighting frame.

12. The retrofit lighting kit of claim 11, wherein the secondary light component comprises a plurality of sequentially connected LED light units.

13. The retrofit lighting it of claim 12, wherein the LED light units are secured to the underside of the lighting frame.

14. The retrofit lighting kit of claim 12, wherein the lighting frame comprises a central opening permitting light from a primary light component of the lighting fixture to pass through said central opening.

15. The retrofit lighting kit of claim 11, further comprising a power source and a controller for controlling power to the secondary light component independently of a primary light component of the lighting fixture.

* * * * *